US008739439B2

(12) United States Patent
Asofsky et al.

(10) Patent No.: US 8,739,439 B2
(45) Date of Patent: Jun. 3, 2014

(54) MULTI-COLOR SIMULATED FLAME SYSTEM FOR ELECTRIC FIREPLACES

(75) Inventors: Mark Asofsky, Delray Beach, FL (US); Tyler Nemes, Delray Beach, FL (US)

(73) Assignee: Twin-Star International, Inc., Delray Beach, FL (US)

( * ) Notice: Subject to any disclaimer, the term of this patent is extended or adjusted under 35 U.S.C. 154(b) by 0 days.

(21) Appl. No.: 12/972,678

(22) Filed: Dec. 20, 2010

(65) Prior Publication Data

US 2012/0155075 A1 Jun. 21, 2012

(51) Int. Cl.
*G09F 19/12* (2006.01)

(52) U.S. Cl.
USPC ..... 40/428

(58) Field of Classification Search
USPC ..... 40/428
See application file for complete search history.

(56) References Cited

U.S. PATENT DOCUMENTS

| | | | | |
|---|---|---|---|---|
| 1,655,987 | A | 1/1928 | Dickinson | |
| 1,827,941 | A | 10/1931 | Gross | |
| 1,867,740 | A | 7/1932 | Guy | |
| 2,684,244 | A | 7/1954 | Brooks | |
| 3,699,697 | A | 10/1972 | Painton | |
| 3,978,598 | A | 9/1976 | Rose et al. | |
| 5,635,898 | A | 6/1997 | Walters | |
| 6,269,567 | B1 * | 8/2001 | MacPherson et al. | 40/428 |
| 6,385,881 | B1 | 5/2002 | Hess | |
| 6,393,207 | B1 * | 5/2002 | Martin et al. | 392/348 |
| 6,564,485 | B1 * | 5/2003 | Hess | 40/428 |
| 6,919,884 | B2 | 7/2005 | Mix | |
| 6,944,982 | B2 * | 9/2005 | Schroeter et al. | 40/428 |
| 7,080,472 | B2 | 7/2006 | Schroeter | |
| 7,210,256 | B2 | 5/2007 | Rosserot | |
| 7,770,312 | B2 * | 8/2010 | Stinson et al. | 40/428 |
| 8,136,276 | B2 | 3/2012 | O'Neill | |
| 8,361,367 | B2 | 1/2013 | Hess et al. | |
| 8,480,937 | B2 | 7/2013 | Hess | |
| 2004/0264949 | A1 | 12/2004 | Deng | |
| 2005/0063685 | A1 * | 3/2005 | Bristow | 392/348 |
| 2006/0098428 | A1 | 5/2006 | Rosserot | |
| 2007/0175074 | A1 | 8/2007 | O'Neill | |
| 2008/0028648 | A1 | 2/2008 | O'Neill | |
| 2009/0126241 | A1 | 5/2009 | Asofsky | |

* cited by examiner

*Primary Examiner* — Joanne Silbermann
(74) *Attorney, Agent, or Firm* — Johnson & Martin, P.A.; James David Johnson

(57) ABSTRACT

A lighting system and methods for producing multi-color light effects are described. The multi-color light effects can feature at least two colors of light projected inside a firebox of an electric fireplace. The lighting system includes a projection surface, a reflective spindle, a first light-emitting device, and at least a second light-emitting device. The first light-emitting device projects light of a first color onto the reflective spindle. Light from the first light-emitting device striking the reflective spindle is reflected onto the projection surface, which can be a projection screen installed in the firebox of the electric fireplace. The second light-emitting device projects light of a second color directly onto the projection surface. The first color light and second color light can be projected onto adjacent, overlapping light projection areas of the projection screen so as to produce a realistic multi-color simulated flame effect.

20 Claims, 6 Drawing Sheets

MULTI-COLOR SIMULATED FLAME SYSTEM FOR ELECTRIC FIREPLACES

FIELD OF THE INVENTION

The invention relates to a lighting system. More particularly, the invention relates to a system for producing simulated flame effects in multiple colors in electric fireplaces.

BACKGROUND

As a source of heat and for aesthetic reasons, fireplaces are frequently incorporated into homes. There are currently several fireplace options available to consumers: traditional fuel (wood or coal)-burning fireplaces, gas-burning fireplaces, and electric fireplaces. Traditional fuel-burning fireplaces generally offer the greatest heat-production and aesthetics, but require more set-up and maintenance time to operate. Gas-burning fireplaces offer a real flame and convenience, but lack the natural sound, flickering, and shadowing associated with traditional fuel-burning fires. Electric fireplaces do not offer a real flame, but have many safety and convenience features.

Many conventional electric fireplaces also lack a visually attractive and realistic flame effect. For example, a conventional electric fireplace does not feature a multi-color light gradient that can be seen in real flames. Natural fires generally include multiple colors, shades, and hues within their flames. Conventional electric fireplaces have not replicated this multi-color gradient in a manner that is visually appealing and realistic.

A need exists for a lighting system that can be used with an electric fireplace and other devices to create a realistic, multi-color simulated flame effect.

SUMMARY

The invention features lighting systems and methods for producing multi-color light effects. The multi-color light effects can feature at least two colors of light projected inside a firebox of an electric fireplace. The lighting system includes a projection surface, a reflective spindle, a first light-emitting device, and at least a second light-emitting device. The first light-emitting device projects light of a first color onto the reflective spindle. Light from the first light-emitting device striking the reflective spindle is reflected onto the projection surface, which can be a projection screen installed in the firebox of the electric fireplace. The second light-emitting device projects light of a second color directly onto the projection surface. The first color light and second color light can be projected onto adjacent, overlapping light projection areas of the projection screen so as to produce a realistic multi-color simulated flame effect. Each light-emitting device may feature only a single color of light elements or each may include light elements of two or more colors.

The lighting system provides an advantage in creating a realistic simulated flame effect having multiple colors that can be used in electric fireplaces. The first and second colors emitted onto the projection screen by the first and second light-emitting devices produce a gradient of colors, shades, and hues imitative of real flames providing a more visually aesthetic appearance to the electric fireplace or other device utilizing the lighting system.

Accordingly, the invention features a lighting system that includes a projection surface, a reflective spindle, a first light-emitting device, and at least a second light-emitting device. The first light-emitting device can be used to project light of a first color onto the reflective spindle. The light from the first light-emitting device striking the reflective spindle is reflected onto the projection surface. The at least second light-emitting device can project light of a second color directly onto the projection surface.

In another aspect, the invention can feature the lighting system being disposed inside a housing of an electric fireplace to create a simulated flame effect that includes simulated flames of at least two colors.

In another aspect, the invention can feature the first light-emitting device including a first panel of a plurality of light-emitting diodes of the first color.

In another aspect, the invention can feature the at least second light-emitting device including a second panel of a plurality of light-emitting diodes of the second color.

In another aspect, the invention can feature the first light-emitting device being positioned in front of the reflective spindle.

In another aspect, the invention can feature the at least second light-emitting device being installed above the reflective spindle so that its light is projected onto the reflective spindle and reflected by the reflective spindle onto the projection screen.

In another aspect, the invention can feature the at least second light-emitting device being positioned so that light emitted by the second plurality of light-emitting diodes does not strike the reflective spindle.

In another aspect, the invention can feature the at least second light-emitting device being installed beneath the reflective spindle.

In another aspect, the invention can feature the projection surface being a projection screen.

In another aspect, the invention can feature the projection screen being installed in a firebox of an electric fireplace. The lighting system can be installed behind the projection screen so as to be positioned between the projection screen and a rear wall of the firebox.

In another aspect, the invention can feature light emitted by the first and second light-emitting devices being projected, directly or by reflection, onto a rear surface of the projection screen.

In another aspect, the invention can feature the projection surface including a first light projection area and at least a second light projection area.

In another aspect, the invention can feature the first light projection area being adjacent to and overlapping the at least second light projection area.

In another aspect, the invention can feature light of the first color being projected by the first light-emitting device onto the first light projection area and light of the second color being projected by the at least second light-emitting device onto the at least second light projection area.

In another aspect, the invention can feature light of the first color being projected by the first light-emitting device onto the at least second light projection area and light of the second color being projected by the at least second light-emitting device onto the first light projection area.

In another aspect, the invention can feature the first light projection area being adjacent to and overlapping the at least second light projection area so that light of the second color is projected by the at least second light-emitting device directly onto the second light projection area and light of the first color is projected by the first light-emitting device onto the reflective spindle. The reflective spindle reflects the light of the first color onto the first light projection area.

In another aspect, the invention can feature the lights of first and second colors projected onto the first and at least second light projection areas by the first and second light-emitting devices to create a realistic, multi-color simulated flame effect that is visible on the projection surface.

In another aspect, the invention can feature the projection surface including a flame-shaped section onto which light is projected by at least one of the first and second first light-emitting devices.

In another aspect, the invention can feature the reflective spindle being rotatable by a motor to which it is connected.

In another aspect, the invention can feature the lighting system further including a controller for varying one or more controllable features of the lighting system. The controllable features can include at least two of the following: light color, light intensity, light pattern of display among groups of light elements on each light-emitting device, and power.

In another aspect, the invention can feature the first light-emitting device including a first panel of a plurality of light elements. The plurality of light elements of the first panel can include light elements of a single color or light elements of two or more different colors installed on the first panel.

In another aspect, the invention can feature the at least second light-emitting device including a second panel of a plurality of light elements of the second color. The plurality of light elements of the second panel can include light elements of a single color or light elements of two or more different colors installed on the second panel.

A method of the invention can be used to produce a multi-color simulated flame effect. The method can include the steps of: (a) providing a lighting system that features a first light-emitting device and a second light-emitting device; (b) projecting a first color light produced by the first light-emitting device onto a reflective spindle; (c) rotating the reflective spindle and reflecting the first color light onto a projection screen; and (d) projecting a second color light produced by the second light-emitting device onto the projection screen to create a multi-color simulated flame effect that is visible on the projection screen.

Another method of the invention includes the step of overlapping the first color light and the second color light that is projected onto the projection screen so that the multi-color simulated flame effect creates a gradient color area.

Another method of the invention includes a step selected from the group of: projecting the second color light directly onto the projection screen, or projecting the second color light onto the reflective spindle and reflecting the projected second color light off of the reflective spindle onto the projection screen.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
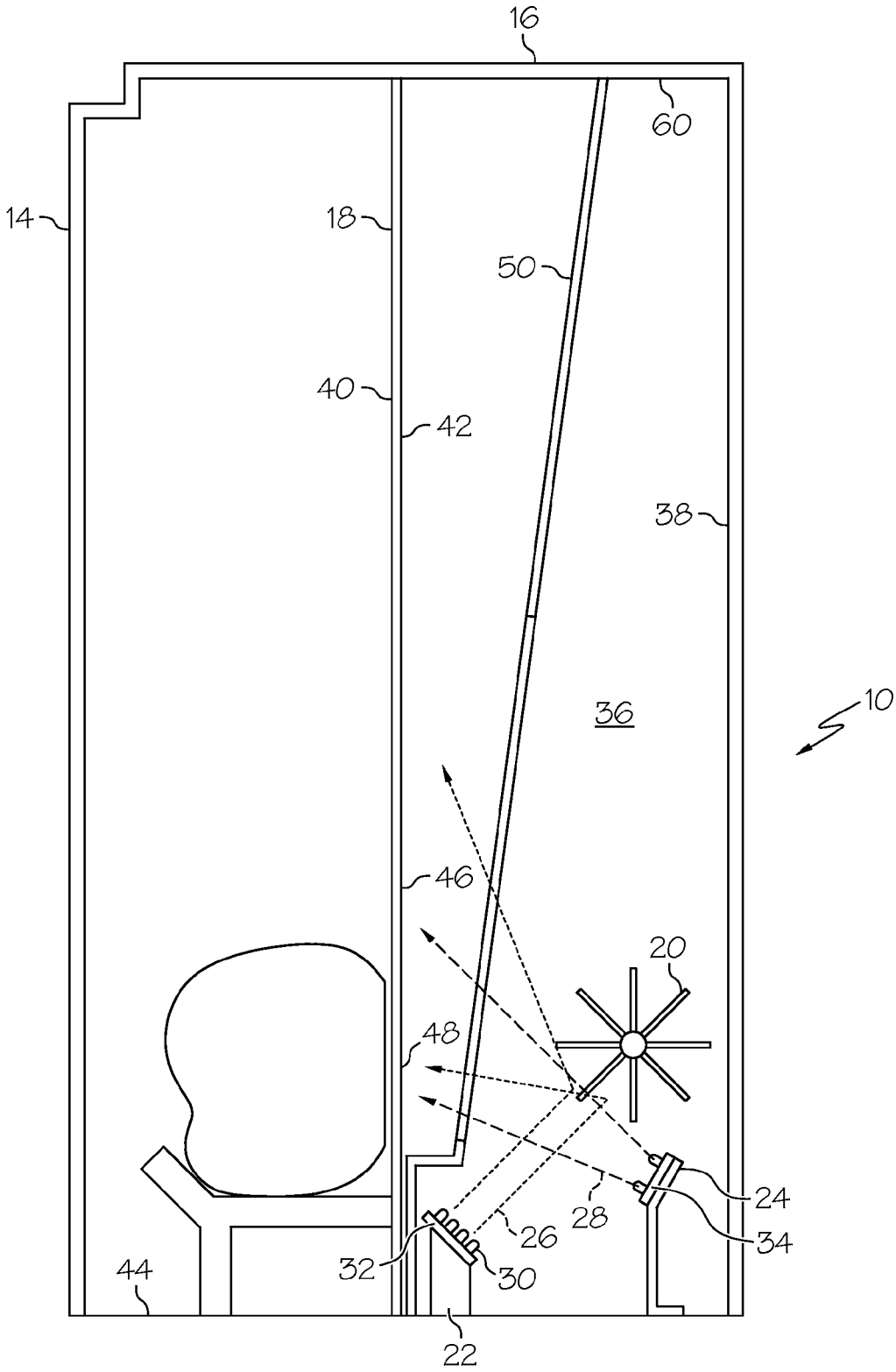
FIG. 1 is a side view of an electric fireplace having a lighting system installed between a projection screen and a rear wall of a firebox of the electric fireplace.

The invention provides a lighting system 10 that can be used to create a multi-color light effect 12. In an exemplary embodiment, shown in FIGS. 1-4, which will be referred to throughout the specification herein, the multi-color light effect 12 created by the lighting system 10 can be produced inside an electric fireplace 14 as a multi-color simulated flame effect; however, in other embodiments, the system can be used in other devices to produce multi-color light effects, for example, in any apparatus, device, or system in which the projection of multi-color simulated flame effects is desired. In the exemplary embodiment, the lighting system 10 can be installed inside a housing 16 of the electric fireplace 14, for example, inside a firebox 36 of the electric fireplace.

The lighting system 10 includes a projection surface 18, a reflective spindle 20, a first light-light emitting device 22, and a second light-emitting device 24. The first light-emitting device 22 produces light of a first color 26 and the second light-emitting device 24 produces light of a second color 28. The lighting system 10 uses the first and second light-emitting devices 22 and 24 to create a simulated flame effect 12 that includes simulated flames of at least two colors, i.e., the first color 26 and the second color 28. In alternate embodiments, the lighting system 10 may include more than two light-emitting devices, e.g., 3, 4, 5, or more light-emitting devices. Each light-emitting device of the system 10 can feature a plurality of light elements 30. In an exemplary embodiment, the light elements 30 can be light-emitting diodes (LEDs). In other embodiments of the lighting system 10, the light elements 30 can be incandescent bulbs, fluorescent bulbs (e.g., compact fluorescent lamps), gas discharge lamps (e.g., neon lights), or any other light bulb, lamp, or light element suitable for installing on the light-emitting device and inside an electric fireplace.

The plurality of light elements 30 of the first light-emitting device 22 can be arranged on and electrically connected to a first panel 32. Similarly, the plurality of light elements 30 of the second light-emitting device 24 can be arranged on and electrically connected to a second panel 34. The first and second panels 32 and 34 can be permanently installed on and electrically connected to their respective light-emitting devices 22 and 24, or in another embodiment, the first and second panels can be removably installed on and electrically connected to their respective light-emitting devices. In embodiments in which the panels are removable from their respective light-emitting devices, the panels may be replaceable with other panels featuring a different color, or combination of colors, of lights.

Each light-emitting device can include a single color of light elements 30 installed thereon or more than one color of light elements installed thereon. For example, the first light-emitting device 22 could include light elements 30 of two different colors and the second light-emitting device 24 could include light elements 30 of only a single color. In another example, the first light-emitting device 22 could feature light elements 30 having only a single color and the second light-emitting device 24 could light elements 30 of two or more colors. In still another example, the first light-emitting device 22 could include light elements 30 of two or more colors and the second light-emitting device 24 also could include light elements 30 of two or more colors. In all embodiments of the invention, the first light-emitting device 22 will include some light elements 30 of at least one color that is different than the color of the light elements 30 of the second light-emitting device 24.

In an exemplary embodiment, the majority of the light elements 30 on a panel are orange with five or fewer (e.g., one or two) red light elements. Light elements 30 can be provided in any color to produce light of any color; however, orange, red, and yellow lights will be most commonly used, particularly for projecting light of those colors onto upper portions of the projection surface 18 as those colors most nearly imitate the colors of real flames. Blue, violet, or indigo light elements 30 may be used to with one of the light-emitting devices 22, 24 to produce the blue or deep purple colors that sometimes appear in a glow just above the logs or other fuel feeding a real fire. In one embodiment, the first light-emitting device 22 can include orange, red, or yellow light elements while the second light-emitting device 24 can include blue, indigo, or violet light elements.

Figure 5:
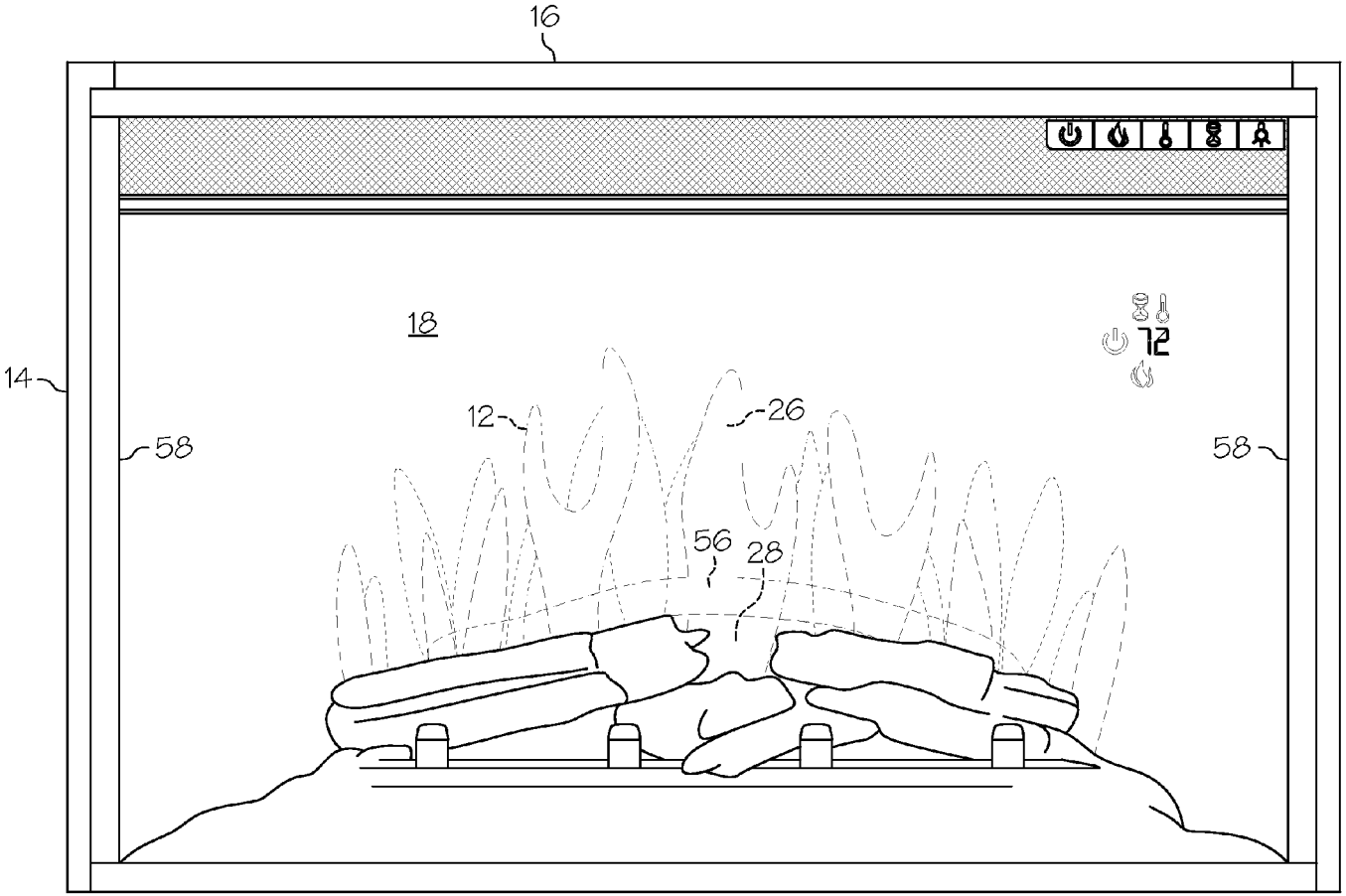
FIG. 5 is a front view of the electric fireplace of FIG. 1 illustrating simulated flames having been projected onto a rear surface of the projection screen by the lighting system that are visible on a front surface of the projection screen in light of a first color and light of a second color.

The lighting system 10 can be installed inside the firebox 36 between the projection surface 18 and a rear wall 38 of the firebox. The projection surface 18 can be a projection screen having a front surface 40 that faces outward so as to be visible to a person looking at the electric fireplace 14 from its outside and a rear surface 42 that faces inward toward the rear wall 38 of the firebox 36. As shown in FIG. 5, light that is projected by the lighting system 10 onto the rear surface 42 of the projection screen 18 is visible on the front surface 40 to a person looking at the electric fireplace 14. The projection screen 18 can be constructed from a translucent or semi-transparent material so as to permit light projected onto its rear surface 42 to be visible therethrough on its front surface 40. The material can be glass, plastic, other polymer, artificial cloth or fabric, natural cloth or fabric, or any other material suitable for transmitting some light therethrough from the rear surface 42 so as to be visible to a person on the front surface 40.

As described above and in the drawings, in an exemplary embodiment, the lighting system 10 is installed in the firebox 36 of the electric fireplace 14 between the projection screen 18 and the rear wall 38 of the firebox 36. The first light-emitting device 22 can be positioned in front of the reflective spindle 20 so that it is proximal to the projection screen 18 rather than to the rear wall 38 of the firebox 36. The first light-emitting device 22 can be installed on a floor surface 44 of the firebox 36. Light emitted by the plurality of light elements 30 of the first light-emitting device 22 can be projected onto the reflective spindle 20. The light from the first light-emitting device 22 projected onto the reflective spindle 20 is then reflected onto the rear surface 42 of the projection screen 18. The light of the first color 26 emitted by the first light-emitting device 22 can be reflected by the reflective spindle 20 onto a first light projection area 46 of the projection screen 18.

As shown in FIG. 1, the second light-emitting device 24 can be positioned inside the firebox 36 so that light emitted by its plurality of light elements 30 does not strike the reflective spindle 20. In an exemplary embodiment, the second light-emitting device 24 can be installed beneath the reflective spindle 20 so that its light is projected directly onto the rear surface 42 of the projection screen 18 without striking the reflective spindle 20. The second light-emitting device 24 can be installed on a floor surface 44 of the firebox 36. The light of the second color 28 emitted by the second light-emitting device 24 can be projected directly onto a second light projection area 48 of the projection screen 18.

Figure 6:
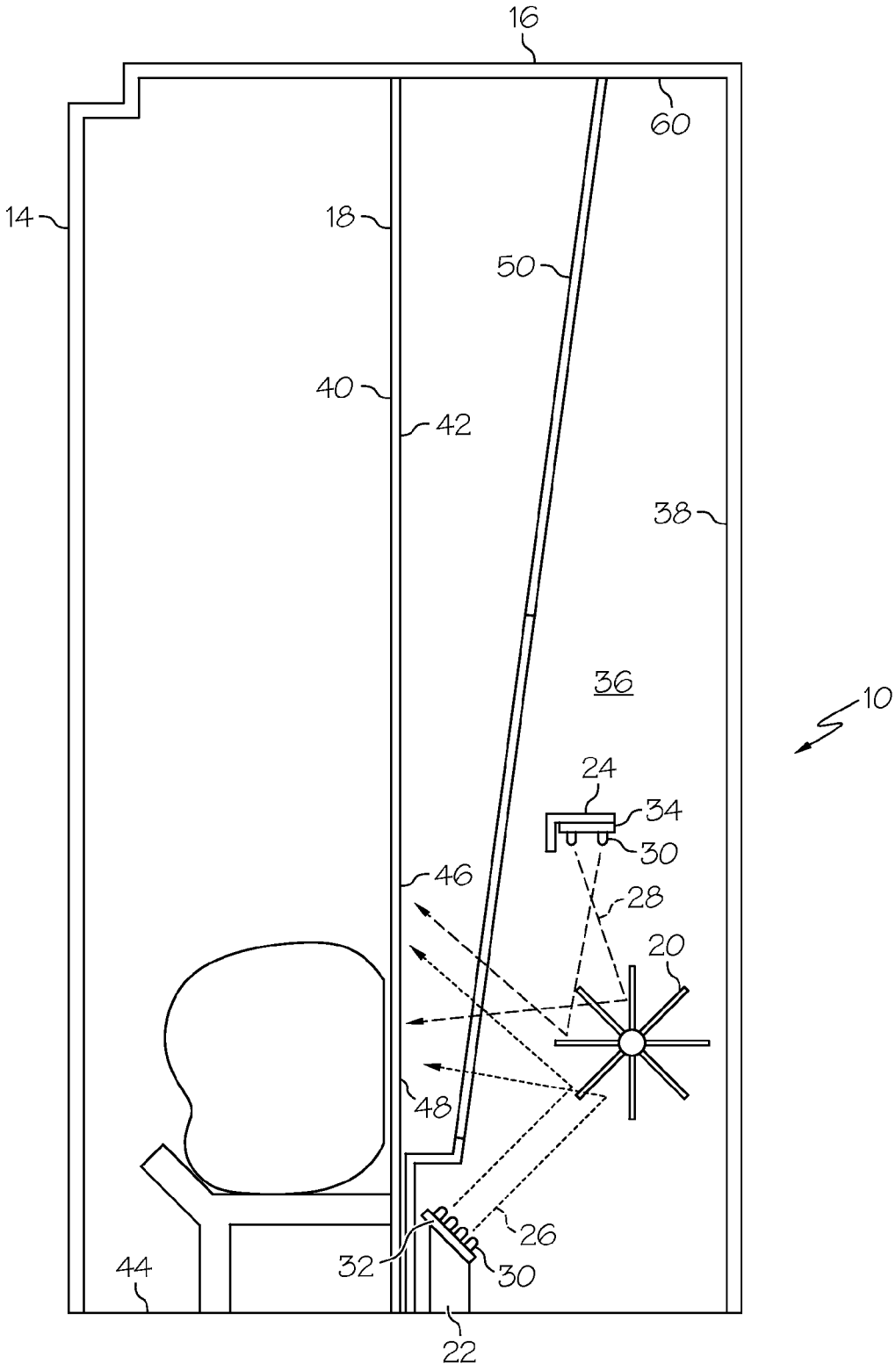
FIG. 6 is a side view of an electric fireplace having another embodiment of a lighting system installed between a projection screen and a rear wall of a firebox of the electric fireplace.

In another embodiment, shown in FIG. 6, the second light-emitting device 24 can be installed above the reflective spindle 20 so that its light is projected downward onto the reflective spindle 20. The reflective spindle 20 then reflects the second color of light 28 emitted by the second light-emitting device 24 onto the rear surface 42 of the projection screen. In this embodiment, the second light-emitting device 24 can be installed on the rear wall 38, a side wall 58, or a top inner surface 60 of the firebox 36. From this position above the reflective spindle, the light of the second color 28 emitted by the second light-emitting device 24 can be projected onto the reflective spindle and reflected from there onto the first light projection area 46 of the projection screen 18. Light of the second color 28 is thereby concentrated in the first light projection 46, i.e., an upper portion of the projection screen 18, while light of the first color 26 emitted by the first light-emitting device is projected onto the reflective spindle 20 and reflected from there onto the second light projection area 48, i.e., concentrated on a lower portion of the projection screen 20. The two separate areas of first color and second color light reflected onto the projection screen 18 by the reflective spindle 20 overlap to create the gradient multi-colored light effect 12.

Figure 2:
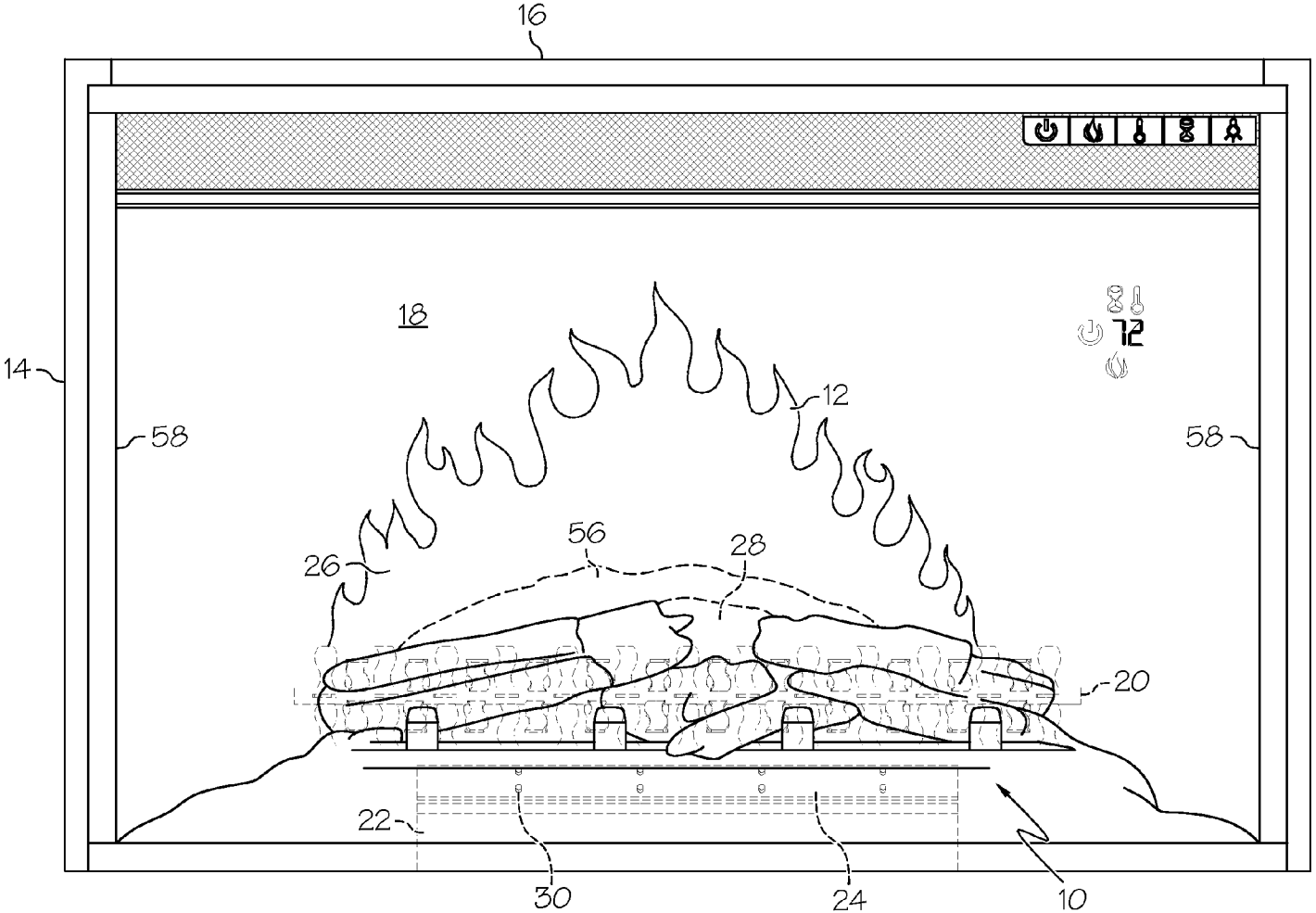
FIG. 2 is a front view of an electric fireplace having the lighting system of FIG. 1, which is illustrated in phantom view installed behind the projection screen.
Figure 3:
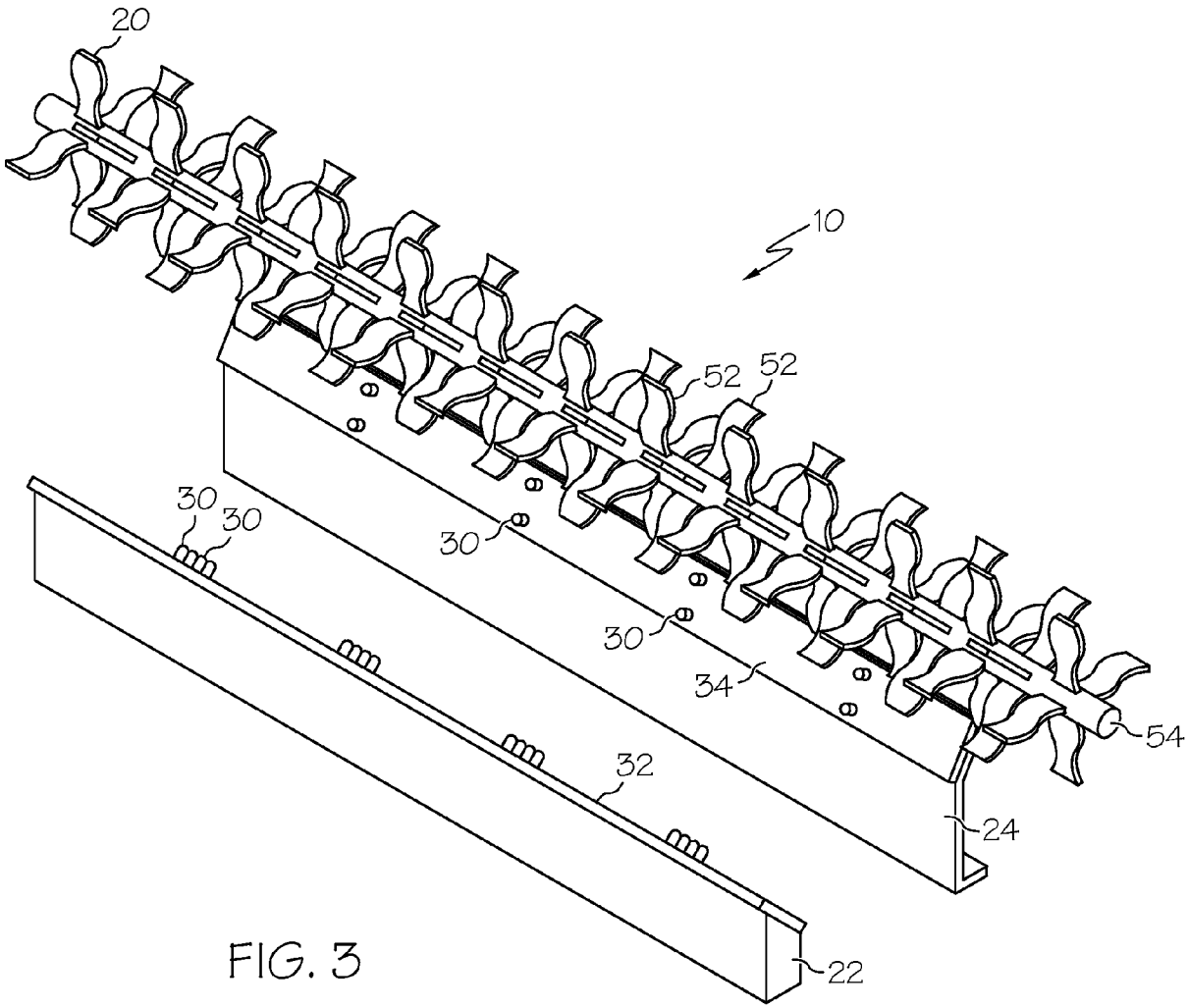
FIG. 3 is a front perspective view of the lighting system of FIG. 1.
Figure 4:
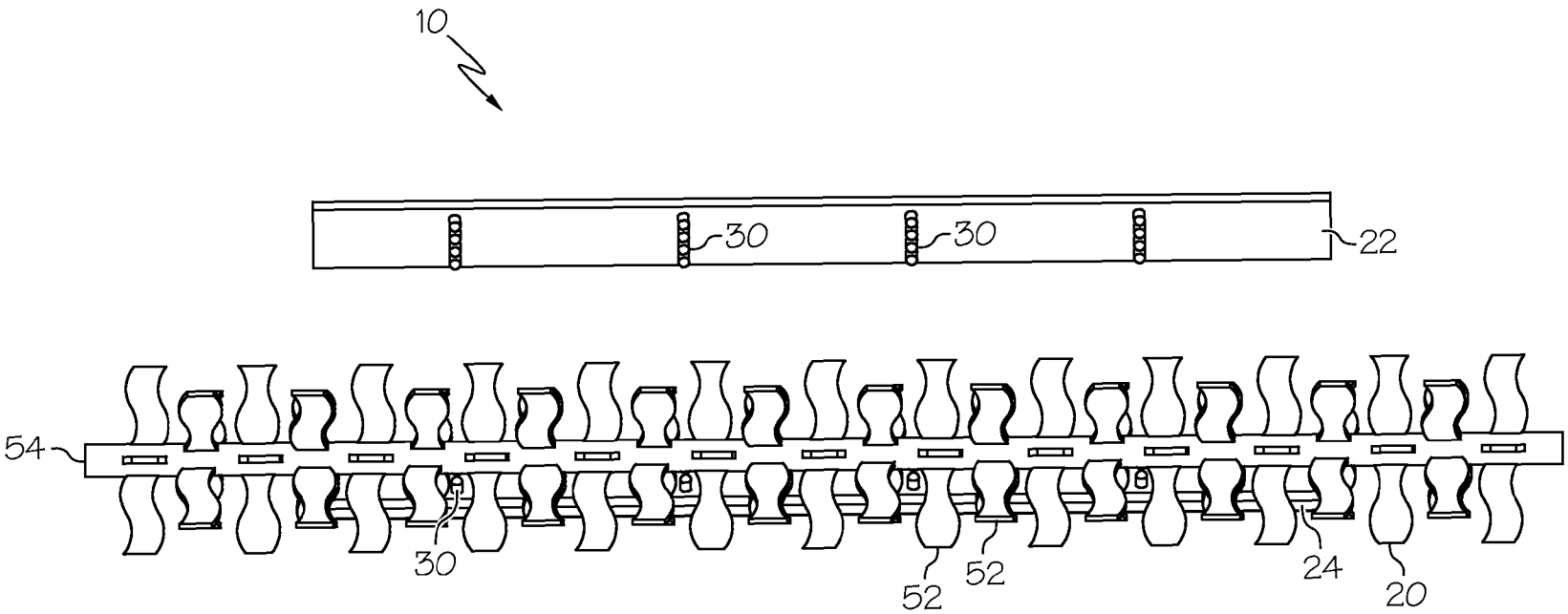
FIG. 4 is a top view of the lighting system of FIG. 1.

The first light projection area 46 can be located in a position that is primarily above the second light projection area 48 on the projection screen 18. In an exemplary embodiment, the first light projection area 46 can be located adjacent to and overlapping the at least second light projection area 48 on the projection screen 18. In embodiments of the lighting system 10 having more than two light-emitting devices, the projection screen 18 can include two, three, four, five, or more light projection areas. By projecting the lights of first and second colors 26 and 28 onto the first and second light projection areas 46 and 48 from the first and second light-emitting devices 22 and 24, a realistic, multi-color simulated flame effect 12 is created that is visible on the front surface 40 of the projection screen 18. The multi-color simulated flame effect 12 can include flame areas of the first and second colors 26 and 28 as well as a color gradient area 56 as shown in FIGS. 2 and 5. The color gradient area 56 can be an area in which the first color 26 and the second color 28 of light mix and gradually blur or fade into one another at upper and lower edges of the color gradient area.

For example, the multi-color flame effect 12 in the first light projection area 46 at the top of the projection screen 18 can be orange as in a real flame. The multi-color flame effect 12 in the second light projection area 48 at the bottom of the projection screen can be blue as is often seen just above a fuel source burning at a very high temperature. The multi-color flame effect 12 displayed within the color gradient area 56 between and in the overlapping areas of the first light projection area 46 and second light projection area 48 can be orange or yellow at an upper edge of the area 56; a mixture of orange, yellow, blue, indigo, or violet in a central portion of the area 56; and fading to blue or indigo at a lower edge of the area 56.

The projection screen 18 can feature a flame-shaped section 50 onto which light is projected by at least one of the first and second first light-emitting devices 22, 24. The flame-shaped section 50 assists in creating the multi-color simulated flame effect 12 in the shape of natural flames that are visible on the front surface 40 of the projection screen 18.

The lighting system 10 further includes a motor (not shown in the drawings) connected to the reflective spindle 20 so as to rotate the reflective spindle. The reflective spindle 20 can feature a plurality of reflector elements 52 that are attached to an extend outward from an axis element 54 of the reflective spindle. The motor is connected to at least one end of the axis element 54 to drive the rotational motion of the reflective spindle 20. As the reflective spindle 20 is rotated by the motor, light from the first light-emitting device 22 strikes the plurality of reflector elements 52 and is reflected onto the projection screen 18 to simulate the "licking" or "dancing" effect of real flames.

The lighting system 10 can further include a controller (not shown in the drawings) for varying one or more controllable features of the lighting system. The controllable features can include at least two of the following: light color, light intensity, light pattern of display among groups of light elements on each light-emitting device, and power.

The lighting system 10 is connected to a power source (not shown in the drawings) that provides electricity to operate the electrical and mechanical components of the system. Any suitable power source may be used with the lighting system.

The invention also relates to methods that can be used to produce a multi-color simulated flame effect. The methods use a lighting system as described herein, which features a first light-emitting device and a second light-emitting device. In one step of the method, a first color light produced by the first light-emitting device is projected onto a reflective spindle. In another step of the method, the reflective spindle rotates and reflects the first color light onto a first light projection area of a projection screen. In another step of the method, a second color light produced by the second light-emitting device is projected directly onto a second light projection area of the projection screen to create a multi-color simulated flame effect that is visible on the projection screen.

The method can also include the step of installing the lighting system in a firebox between the projection screen and a rear wall of the firebox of an electric fireplace.

In another possible step of the method, a plurality of light elements installed on each light-emitting device may be independently controlled or controlled in groups so as to alternate the light elements to which power is supplied. For example, where a light-emitting device includes light elements of two colors, the light elements of one color on the device could be controlled independently of the light elements of the other color.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A lighting system comprising:

a projection surface comprising a first light projection area and at least a second light projection area, wherein the first light projection area is adjacent to and overlaps the at least second light projection area;

a first light-emitting device for projecting reflected light of a first color onto the first light projection area of the projection surface; and at least a second light-emitting device for projecting light of a second color directly onto the at least second light projection area of the projection surface;

wherein the first light-emitting device and second light-emitting are installable behind the projection surface;

wherein at least the first light-emitting device creates a multi-chromatic flame effect comprising a concentration of light proximate to a simulated fuel source with visible wavelengths ranging between about yellow and about red and the second light-emitting device creates a multi-chromatic flame effect comprising a concentration of light proximate to a simulated fuel source with visible wavelengths ranging between about violet and about blue;

wherein the light of the first color overlaps the light of the second color to produce the multi-chromatic flame effect appearing with a gradient of colors, shades, and hues to imitate a real flame.

2. The lighting system of claim 1, wherein the lighting system is disposed inside a housing of an electric fireplace to create a simulated flame effect comprising simulated flames of at least two colors.

3. The lighting system of claim 1, wherein the first light-emitting device comprises a first panel of a plurality of light-emitting diodes of the first color.

4. The lighting system of claim 1, wherein the at least second light-emitting device comprises a second panel of a plurality of light-emitting diodes of the second color.

5. The lighting system of claim 1, wherein the first light-emitting device is positioned in front of a single reflective spindle and the at least second light-emitting device is installed beneath the reflective spindle to be projected directly onto the projection screen without striking the reflective spindle.

6. The lighting system of claim 5, wherein the at least second light-emitting device comprises a second plurality of light emitting diodes, and wherein the at least second light-emitting device is positioned so that light emitted by the second plurality of light-emitting diodes does not strike the reflective spindle.

7. The lighting system of claim 5, wherein the reflective spindle is rotatable and comprises a plurality of reflector elements extending outwardly from an axis element to reflect light outwardly from the reflective spindle, wherein the light does not pass through the reflective spindle.

8. The lighting system of claim 1, wherein the projection surface comprises a projection screen that is installed in a firebox of an electric fireplace, and wherein the lighting system is installed behind the projection screen so as to be positioned between the projection screen and a rear wall of the firebox.

9. The lighting system of claim 8, wherein light emitted by the first and second light-emitting devices is projected, directly or by reflection, onto a rear surface of the projection screen.

10. The lighting system of claim 1, wherein light of the first color is projected by the first light-emitting device onto the at least second light projection area and light of the second color is projected by the at least second light-emitting device onto the first light projection area.

11. The lighting system of claim 1, wherein the first light projection area is adjacent to and overlaps the at least second light projection area so that as light of the second color is projected by the at least second light-emitting device directly onto the second light projection area, light of the first color is projected by the first light-emitting device onto a reflective spindle, wherein the reflective spindle reflects the light of the first color onto the first light projection area.

12. The lighting system of claim 11, wherein the lights of first and second colors projected onto the first and at least second light projection areas by the first and second light-emitting devices creates a realistic, multi-color simulated flame effect that is visible on the projection surface.

13. The lighting system of claim 1, wherein the projection surface comprises a flame-shaped section onto which light is projected by at least one of the first and second first light-emitting devices.

14. The lighting system of claim 1, wherein the lighting system is controllable to vary one or more controllable features of the lighting system, wherein the controllable features comprise two or more features selected from the group consisting of: light color, light intensity, light pattern of display among groups of light elements on each light-emitting device, and power.

15. The lighting system of claim 1, wherein the first light-emitting device comprises a first panel of a plurality of light elements, wherein the plurality of light elements of the first panel comprises light elements of a single color or light elements of two or more different colors installed on the first panel.

16. The lighting system of claim 1, wherein the at least second light-emitting device comprises a second panel of a plurality of light elements of the second color, wherein the plurality of light elements of the second panel comprises light elements of a single color or light elements of two or more different colors installed on the second panel.

17. A lighting system for creating a multi-chromatic flame effect, the lighting system comprising:

a projection surface;

a first light-emitting device for projecting light of a first color indirectly onto the projection surface; and at least a second light-emitting device for projecting light of a second color directly onto the projection surface;

wherein at least the first light-emitting device creates a multi-chromatic flame effect comprising a concentration of light proximate to a simulated fuel source with visible wavelengths ranging between about yellow and about red and the second light-emitting device creates a multi-chromatic flame effect comprising a concentration of light proximate to a simulated fuel source with visible wavelengths ranging between about violet and about blue;

wherein the projection surface comprises a first light projection area and at least a second light projection area, and wherein the first light projection area is adjacent to and overlaps the at least second light projection area;

wherein the first light-emitting device and second light-emitting are installable behind the projection surface;

wherein the light of the first color overlaps the light of the second color to produce the multi-chromatic flame effect appearing with a gradient of colors, shades, and hues to imitate a real flame.

18. The lighting system of claim 17, wherein light of the first color is projected by the first light-emitting device onto the first light projection area and light of the second color is projected by the at least second light-emitting device onto the at least second light projection area.

19. The lighting system of claim 18, wherein the first light projection area is adjacent to and overlaps the at least second light projection area so that as light of the second color is projected by the at least second light-emitting device directly onto the second light projection area, light of the first color is projected indirectly by the first light-emitting device onto the first light projection area.

20. The lighting system of claim 19, wherein the lights of first and second colors projected onto the first and at least second light projection areas by the first and second light-emitting devices creates a realistic, multi-color simulated flame effect that is visible on the projection surface.

* * * * *